US011414169B2

(12) United States Patent
Moerbe

(10) Patent No.: US 11,414,169 B2
(45) Date of Patent: Aug. 16, 2022

(54) ASYMMETRICALLY SHAPED FLANKING RUDDERS

(71) Applicant: MBLH MARINE, LLC, Port Arthur, TX (US)

(72) Inventor: Ron Moerbe, Port Arthur, TX (US)

(73) Assignee: MBLH MARINE, LLC, Port Arthur, TX (US)

( * ) Notice: Subject to any disclaimer, the term of this patent is extended or adjusted under 35 U.S.C. 154(b) by 0 days.

(21) Appl. No.: 17/013,200

(22) Filed: Sep. 4, 2020

(65) Prior Publication Data

US 2022/0073182 A1 Mar. 10, 2022

(51) Int. Cl.

| | |
|---|---|
| ***B63H 25/06*** | (2006.01) |
| ***B63H 25/38*** | (2006.01) |
| ***B63H 1/14*** | (2006.01) |
| ***B63H 21/14*** | (2006.01) |

(52) U.S. Cl.

CPC ..... *B63H 25/06* (2013.01); *B63H 1/14* (2013.01); *B63H 21/14* (2013.01); *B63H 25/38* (2013.01); *B63H 2025/066* (2013.01)

(58) Field of Classification Search

CPC ..... B63H 1/14; B63H 21/14; B63H 25/06; B63H 25/38; B63H 2025/387; B63H 2025/066

USPC ..... 440/49; 114/162, 163

See application file for complete search history.

(56) References Cited

U.S. PATENT DOCUMENTS

| | | | | | |
|---|---|---|---|---|---|
| 899,359 | A * | 9/1908 | Wadagaki | B63H 5/14 | 440/67 |
| 969,642 | A * | 9/1910 | Lund | B63H 25/10 | 114/154 |
| 2,251,133 | A * | 7/1941 | Horstman | B63H 25/38 | 114/163 |
| 3,101,693 | A * | 8/1963 | Schilling | B63H 25/383 | 114/163 |
| 3,828,713 | A * | 8/1974 | Duryea | B63H 25/06 | 114/163 |
| 3,872,817 | A * | 3/1975 | Duryea | B63H 25/06 | 114/163 |
| 4,085,694 | A * | 4/1978 | Schilling | B63H 25/383 | 114/163 |
| 4,860,679 | A * | 8/1989 | Liljestrom | B63B 35/08 | 114/40 |
| 5,445,100 | A * | 8/1995 | Finkl | B63H 25/38 | 114/163 |
| 7,717,052 | B2 * | 5/2010 | Kluge | B63H 25/38 | 114/165 |
| 9,611,009 | B1 * | 4/2017 | Myers | B63H 25/30 | |
| 2017/0240251 | A1 * | 8/2017 | Wait, Jr. | B01D 1/0005 | |

* cited by examiner

*Primary Examiner* — Daniel V Venne

(74) *Attorney, Agent, or Firm* — Norton Rose Fulbright US LLP

(57) ABSTRACT

This disclosure describes flanking rudders, including asymmetrically shaped flanking rudders and methods of manufacturing and using asymmetrically shaped flanking rudders. An exemplary asymmetrically shaped flanking rudder includes an exterior surface having a first shape and an exterior surface having second shape different from the first shape.

20 Claims, 9 Drawing Sheets

ASYMMETRICALLY SHAPED FLANKING RUDDERS

TECHNICAL FIELD

Aspects of the present disclosure relate generally to ship hulls, and more specifically, but not by way of limitation, to flanking rudders.

BACKGROUND

Some marine vessels, such as inland push boats, have flanking rudders to control the marine vessel during backing and/or flanking. For example, flanking rudders are positioned forward of propulsion devices, such as propellers, and can be turned in a direction opposite of propulsion rudders (e.g., rudders aft of the propulsion devices) to twist the marine vessel. Twisting (e.g., spinning) the marine vessel can be used to impart torque or a sideways force on another vessel (e.g., a tow) which causes the other vessel to turn or turn at a higher rate.

Flanking rudders are conventionally known to be a "necessary evil". That is, while flanking rudders provide increased maneuverability, this increased performance comes at a propulsion loss. Specifically, fuel consumption and maximum power are reduced by the inclusion of flanking rudders because flanking rudders alter the flow of water into the propulsion device or devices. Many propulsion devices, such as propellers, act similar to a pump and crudely speaking increase water pressure by a set amount. Flanking rudders disturb and alter the flow of water into the "pump," which reduces a pressure of the water and the output pressure of the pump, i.e., propulsion device. Previous solutions to address this drawback of flanking rudders include modifying the retractable flanking rudders when not in use, such as retractable flanking rudders. Such modifiable or retractable flanking rudders are not generally practical, due to cost and complexity. Also, such types of flanking rudders are often not feasible on some types of marine vessels due to space requirements and hull configurations.

SUMMARY

This disclosure describes improved flanking rudders and methods of manufacturing and using flanking rudders. The flanking rudders disclosed herein have an asymmetrical shape, and are referred to as asymmetrical flanking rudders or just flanking rudders. For example, an exterior surface of the disclosed asymmetrical flanking rudders may have a first shape and an interior surface of the asymmetrical flanking rudders may have a second shape. To illustrate, an exterior surface of the asymmetrical flanking rudders may be angled or rounded and an interior surface of the asymmetrical flanking rudders may be straight (e.g., flat).

Conventional flanking rudders have symmetrical shapes. To illustrate, the flanking rudders have generally and elongated diamond shape with narrow or pointed ends fore and aft and a wider mid-section. This conventional shape was originally designed to reduce drag when the flanking rudders were not in use, that is when moving forward.

In both cases (asymmetrical flanking rudders and conventional symmetrical flanking rudders), the shape and orientation of the flanking rudders generally mirror each other. To illustrate, the flanking rudders generally have complimentary shapes (e.g., "mirror" each other) and have opposite offset angles relative to a centerline of the marine vessel (e.g., a toe angle). Specifically, flanking rudders generally angle inwards (e.g., toe) from front to back and each flanking rudder has a complementary toe angle, such as +3 degrees and −3 degrees.

The disclosed asymmetrically shaped flanking rudders may also have a different configuration/orientation as compared to conventional symmetrical flanking rudders. For example, an offset angle (e.g., toe in angle) of the disclosed asymmetrically shaped flanking rudders may be less than an offset angle of conventional flanking rudders. In conventional symmetrical flanking rudders, the angled surfaces increase an offset angle of the interior surfaces fore from the offset angle of the flanking rudder, and reduce an offset angle of the interior surfaces aft fore from the offset angle of the flanking rudder. When asymmetrically shaped flanking rudders, the offset angle of the interior surface may not change from fore to aft and may be the same as the offset angle of the flanking rudders and/or have a constant offset from the offset angle of the flanking rudders.

Additionally or alternatively, the asymmetrical flanking rudders may have different sizes or positions as compared to conventional flanking rudders, such as larger or smaller and/or further or closer. In some implementations, the asymmetrical flanking rudders may be not symmetrical from fore to aft. For example, a leading edge portion of an interior or exterior surface may have a different shape from a trailing edge portion of a corresponding interior or exterior surface.

The disclosed asymmetrical flanking rudders provide operational benefits of the conventional symmetrical flanking rudders. For example, asymmetrical flanking rudders actually increase a pressure of the water into the propulsion device, and thus generate a net benefit in efficiency and power. Specifically, the asymmetrical flanking rudders cause a high pressure point of the water flow to be pushed further back towards the propulsion device. For example, a high pressure point of the water flow is pushed back from mid flanking rudder to a trailing edge of the flanking rudder. Thus, the disclosed asymmetrical flanking rudders may no longer cause a reduction in operational efficiency or power and can in some instances actually induce an increase in operational efficiency and power as compared to a hull with no flanking rudders.

In some implementations, the asymmetrical flanking rudders are used in single chine hull designs, double chine hull designs, or hybrid chine hull designs. The asymmetrical flanking rudders may be used on or for inland push boats or offshore supply or crew boats. In other implementations, the asymmetrical flanking rudders are used in tugboats, other monohull vessels, and/or non-molded hull vessels. When used on or for inland push boats, such asymmetrical flanking rudders offer improved flanking performance allowing or enabling a single push boat to push multiple barges through waterways (e.g., S-curves) where multiple push boats or multiple boats would normally be used. To illustrate, the asymmetrical flanking rudders offer increased power and efficiency in straight line performance and turning performance such that asymmetrical flanking rudders generate more power and/or impart more torque (i.e., twist) on the barge(s) being pushed. Thus, a push boat including such asymmetrical flanking rudders can perform such complicated procedures with a single boat.

As used herein, various terminology is for the purpose of describing particular implementations only and is not intended to be limiting of implementations. For example, as used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). The term "coupled" is defined as connected, although not necessarily directly, and not necessarily mechanically. Additionally, two items that are "coupled" may be unitary with each other. To illustrate, components may be coupled by virtue of physical proximity, being integral to a single structure, or being formed from the same piece of material. Coupling may also include mechanical, thermal, electrical, communicational (e.g., wired or wireless), or chemical coupling (such as a chemical bond) in some contexts.

The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. As used herein, the term "approximately" may be substituted with "within 10 percent of" what is specified. Additionally, the term "substantially" may be substituted with "within [a percentage] of" what is specified, where the percentage includes 0.1, 1, or 5 percent; or may be understood to mean with a design, manufacture, or measurement tolerance. The phrase "and/or" means and or. To illustrate, A, B, and/or C includes: A alone, B alone, C alone, a combination of A and B, a combination of A and C, a combination of B and C, or a combination of A, B, and C. In other words, "and/or" operates as an inclusive or.

The terms "comprise" (and any form of comprise, such as "comprises" and "comprising"), "have" (and any form of have, such as "has" and "having"), and "include" (and any form of include, such as "includes" and "including"). As a result, an apparatus that "comprises," "has," or "includes" one or more elements possesses those one or more elements, but is not limited to possessing only those one or more elements. Likewise, a method that "comprises," "has," or "includes" one or more steps possesses those one or more steps, but is not limited to possessing only those one or more steps.

Any aspect of any of the systems, methods, and article of manufacture can consist of or consist essentially of—rather than comprise/have/include—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb. Additionally, it will be understood that the term "wherein" may be used interchangeably with "where."

Further, a device or system that is configured in a certain way is configured in at least that way, but it can also be configured in other ways than those specifically described. The feature or features of one embodiment may be applied to other embodiments, even though not described or illustrated, unless expressly prohibited by this disclosure or the nature of the embodiments.

Some details associated with the aspects of the present disclosure are described above, and others are described below. Other implementations, advantages, and features of the present disclosure will become apparent after review of the entire application, including the following sections: Brief Description of the Drawings, Detailed Description, and the Claims.

BRIEF DESCRIPTION OF THE DRAWINGS

A further understanding of the nature and advantages of the present disclosure may be realized by reference to the following drawings. The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Figure 1:
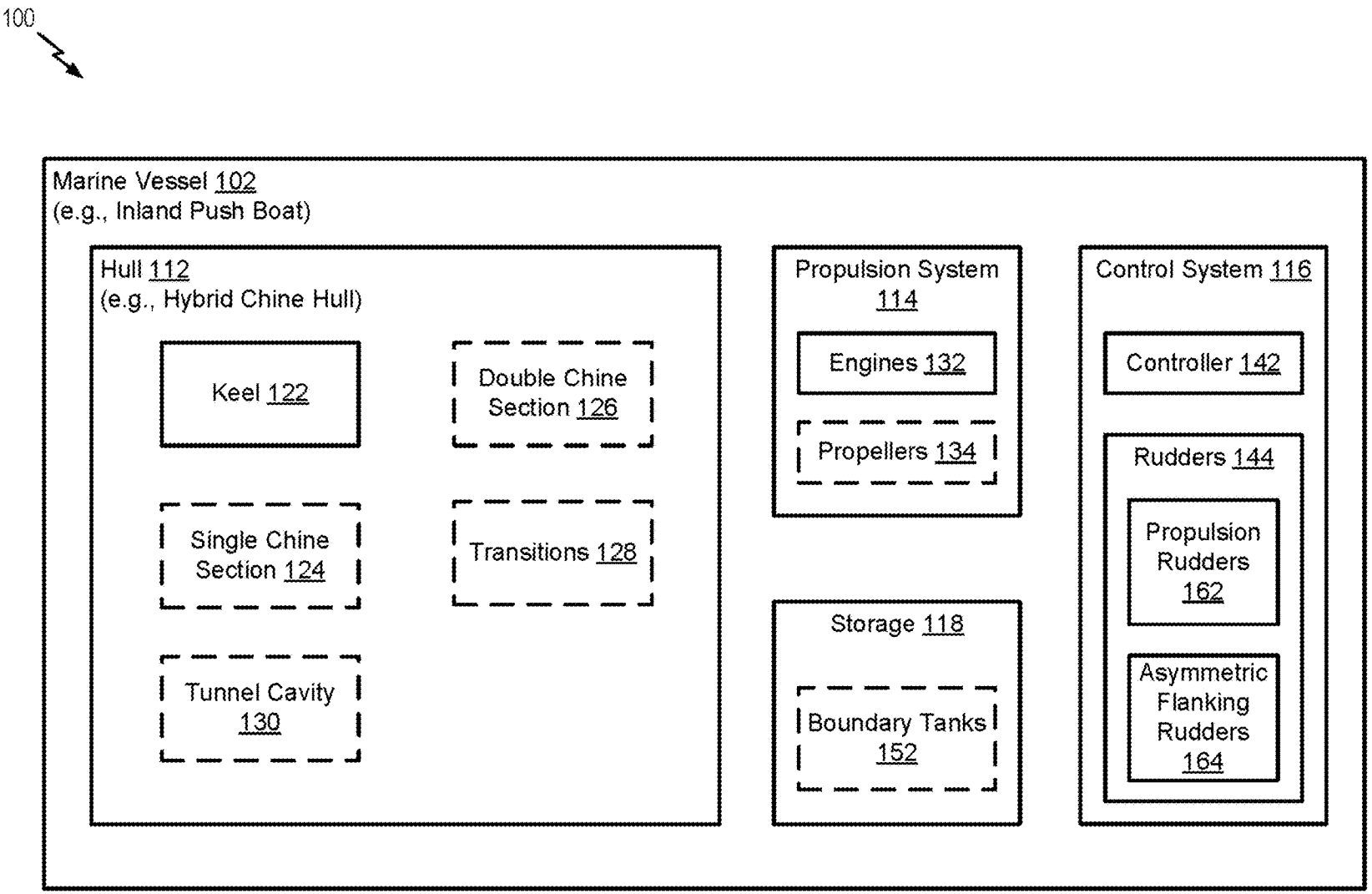
FIG. 1 is a block diagram of an example of marine vessel.

FIG. 1 illustrates a block diagram 100 of a marine vessel 102. Marine vessel 102 includes a hull 112, a propulsion system 114, a control system 116, and storage 118. Marine vessel 102 may include one or more other components and/or system in other implementations. In some implementations, marine vessel 102 includes or corresponds to an inland push boat. In other implementations, marine vessel 102 includes or corresponds an offshore supply or crew boat. In other implementations, marine vessel 102 may another type of vessel, such as an unpowered vessel.

Hull 112 includes a keel 122. Hull 112 may optionally include one or more of a single chine section 124, a double chine section 126, or a transition 128. Keel 122 is a structural member that runs along a majority or an entirety of a centerline of marine vessel 102 from bow to stern. Keel 122 is configured to provide marine vessel 102 control and stability and reduces side to side "slipping." In some implementations, keel 122 is a fixed keel, such as a flat plate keel. Other examples of fixed keels include a full keel, a long keel, a fin keel, a winged keel, a bulb keel, a bar keel, or a bilge keel.

Single chine section 124 include a single chine. A chine, as used herein, is a "sharp" or large angle in a cross-section of hull 112. Thus, a no or zero chine hull has hull cross-section that gradually changes or is rounded, such as a gently curving cross-section or S-bottom hull. The single chine may be a "hard chine" or a "soft chine." A hard chine is where two sides meet at a relatively steep angle and has little to no rounding, while a soft chine is where two sides meet at a relatively shallower angle and has a larger degree of rounding where two planes of the hull 112 come together here to form the chine. In some implementations, single chine section 124 includes a single chine on each side of the keel 122, i.e., the keel 122 does not include or correspond to a chine of the single chine section 124. In a particular implementation, the keel 122 does include or correspond to a separate chine, such as flat plate keel. In such implementations, the hull 112 will often have one panel or plane (made of multiple panels aligned along the plane) that forms the hull section on each side of the keel 122. Alternatively, the keel 122 may include a chine or correspond to a chine, i.e., have a hard edge. Thus, when the keel 122 is or forms the chine, a particular cross-section of hull 112 may have three chines and be referred to as a triple chine hull.

Double chine section 126 includes two chines, such as an upper chine and a lower chine. In some implementations, double chine section 126 includes two chines on each side of keel 122. The double chine section 126 may include two panels or planes that form the hull section on each side of the keel 122. Thus, the hull 112 may have four chines and be referred to as a 4 chine hull. In some implementations where the keel 122 may include a chine or correspond to a chine, a particular cross-section of hull 112 may have five chines and be referred to as a 5-chine hull. Each of the single chine section 124 and the double chine section 126 may be formed from multiple pieces of material.

A transition 128 or transition section is positioned between the single chine section 124 and the double chine section 126. For example, the single chine of the single chine section 124 may split or fare into two chines, such as the upper and lower chines of double chine section 126 at transition 128. In some implementations, hull 112 includes another single chine section or another double chine section. In such implementations, hull 112 includes another transition, such as between the additional single or double chine section and another section 124, 126.

Placement of the single chine section 124 and the double chine section 126 can vary according to marine vessel 102 size and design characteristics. For example, for an inland push boat, single chine section 124 may be positioned in a forward hull section and/or mid-hull section and double chine section 126 may be positioned aftward of the single chine section 124. In such implementations, single chine hull section 124 provides stability along a fore portion of hull 112 and double chine section 126 provides efficiency and maneuverability in an aft section of hull 112.

In some implementations, hull 112 includes or defines a tunnel cavity 130 to direct water towards propulsion system 114. Tunnel cavity 130 can be formed into and/or defined by the hull bottom. Additionally, tunnel cavity can be defined by single chine section 124, double chine section 126, or a combination thereof.

Propulsion system 114 includes engine(s) 132 and propeller(s) 134. As an illustrative, non-limiting example, propulsion system 114 includes two engines 132 and two propellers, each engine 132 coupled to a corresponding propeller 134. Engine 132 may be an inboard engine or an outboard engine. In some implementations, engine 132 is a diesel powered engine. In other implementations, engine 132 is a gasoline powered engine or a turbine engine. Additionally, or alternately, engine 132 includes or corresponds to an electric engine. In some such implementations, engine 132 includes or corresponds to a hybrid engine (e.g., a diesel and electric powered engine). In some implementations, marine vessel 102 further includes a generator.

Control system 116 includes a controller 142 and one or more rudders 144. Controller 142 may include one or more processors couple to one or more memories. The processors are configured to execute instructions stored in the one or more memories. Controller 142 is configured to control components of propulsion system 114, components of control system 116, or a combination thereof. For example, controller 142 may include hardware, software (e.g., one or more instructions) and/or firmware configured to process received inputs, generate control signals, and provide control signals to components of propulsion system 114 and/or components of control system 116.

Rudders 144 are configured to control and steer marine vessel 102. As illustrated in the example of FIG. 1, rudders 144 include propulsion rudders 162 and asymmetric flanking rudders 164. Propulsion rudders 162 are configured to steer or control marine vessel 102 and flanking rudders 164 are configured to control marine vessel during backing and flanking, and optionally are configured to control one or more other vessels. For example, asymmetric flanking rudders 164 are positioned forward of propellers 134 and can be turned in a direction opposite of propulsion rudders 162 to twist marine vessel 102. Twisting (e.g., spinning) marine vessel 102 can be used to impart torque or a sideways force on the other vessel which causes the other vessel to turn.

Asymmetric flanking rudders 164 include asymmetrical flanking rudders as described further with reference to FIGS. 3-11. Asymmetrical flanking rudders are configured to provide operational benefits over conventional, symmetrical rudders, such as the rudders shown in FIG. 2. The operational benefits include increased power and efficiency as compared to conventional, symmetrical rudders and reduced power losses and efficiency losses as compared to no flanking rudders.

Asymmetric flanking rudders 164 often come in pairs, such as two rudders for each propulsion device, such a propeller. To illustrate, each propeller may include two asymmetric flanking rudders 164 positioned fore of the corresponding propeller. A single corresponding propulsion rudder 162 may also be associated with each propeller. An exemplary layout is illustrated and described further with reference to FIG. 11.

Storage 118 includes one or more structures and/or cavities configured to hold provisions, cargo, or both. As illustrated in the example of FIG. 1, storage 118 includes boundary tanks 152. Boundary tanks 152 are configured to store fluids, such as gas, oil, water, etc. Increasing a size of boundary tanks 152 enables marine vessel 102 to operate for longer periods of time before refueling. A single chine section 124, especially around a mid-hull portion of marine vessel 102, provides for larger volume or capacity boundary tanks 152, as compared to double chine section 126. Thus, by employing a single chine section 124 in a mid-hull portion, larger volume or capacity boundary tanks 152 can be achieved.

During operation, marine vessel 102 can be operated in accordance with a type of the vessel and/or a type of hull 112. For example, when marine vessel 102 is an offshore supply boat, marine vessel 102 can be loaded with provisions and cargo and operated in the ocean to bring the provisions and cargo to off-shore oil rigs. As another example, when marine vessel 102 is an inland push boat, marine vessel can be loaded with fuel and other provisions to push and steer unpowered vessels, such as barges, to a destination. To illustrate, one or more barges may be lined up end to end. The barges may include vessels of over 300 feet in length. Marine vessel 102 may operate propulsion system 114 to arrange a bow of marine vessel 102 to contact or couple with a stern of one of the one or more barges. The marine vessel 102 may be operated to push the one or more barges to the destination and decouple from the one or more barges after arriving at the destination. As illustrative, non-limiting examples of operational characteristics of the marine vessel 102 while pushing the one or more barges to the destination, marine vessel may be operated at 3 to 15 knots. Additionally, or alternatively, the one or more barges may have a barge under keel clearances of 1 foot to 10 feet.

During the trip, marine vessel 102 may perform one or more flanking maneuvers to steer the one or more barges along inland waterways. To illustrate, the control system 116 may send control signals to propulsion rudders 162 and asymmetric flanking rudders 164 to orient the rudders 162, 164 to produce a twisting force or torque to cause marine vessel 102 to spin. By producing the twisting force or torque while the marine vessel is contacting or coupled to the one or more barges, the one or more barges will begin to twist, thus enabling marine vessel 102 to steer and turn the one or more barges. Operations of marine vessel 102 are described further with reference to FIG. 12.

Thus, hull 112 includes asymmetrically shaped flanking rudders 164. To illustrate, hull 112 includes the benefits of asymmetric flanking rudders 164 (e.g., mobility), and reduces or eliminates the drawback of conventional, symmetrical flanking rudders (e.g., power and efficiency losses). Accordingly, hull 112 enables marine vessel 102 to have increased maneuverability and efficiency when pushing or turning/flanking (e.g., barge turning/steering operations). Additionally, hull 112 enables marine vessel 102 to have reduce build costs, reduced maintenance costs, increased hull stability, and reliability, as compared to retractable flanking rudders. Consequently, hull 112 may enable safer, more efficient, and more effective marine vessels.

Figure 2:
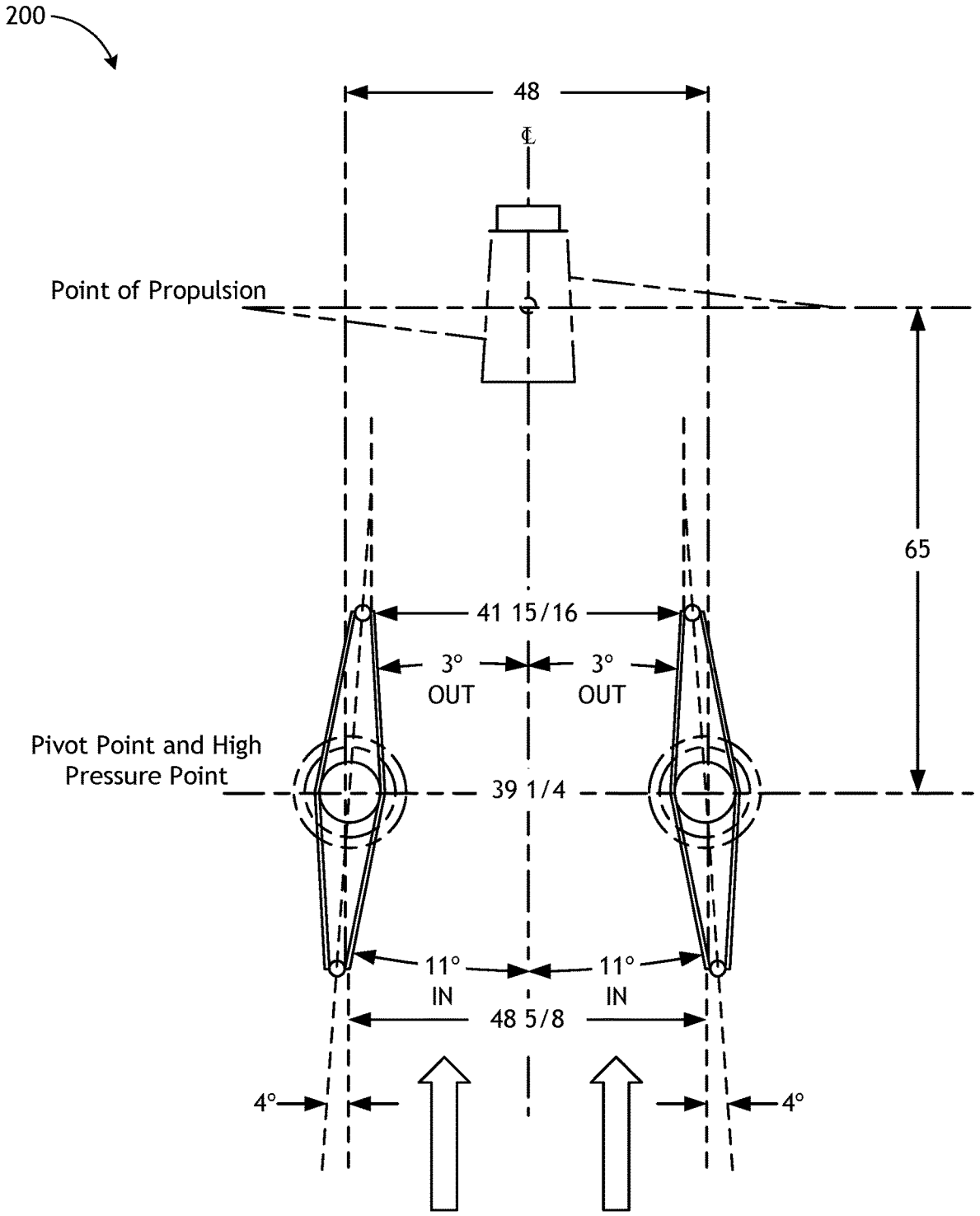
FIG. 2 is a transverse cross-section view of an example of symmetric flanking rudders.

FIG. 2 illustrates a generic cross-section view 200 of a pair of conventional, symmetric rudders in relation to a propeller. In FIG. 2, the cross-section is take across the transverse or swaying axis. Each rudder of the pair has a symmetric shape. In the example of FIG. 2, each rudder has a symmetric shape with respect to a corresponding centerline of the respective rudder.

The rudders of the pair of conventional, symmetric rudders are also symmetrical with respect to one another. For example, in the example of FIG. 2, the rudders are symmetrical with respect to a centerline of the hull. To illustrate, each rudder is complementary or the mirror opposite the other. The rudders both are 24 inches from the centerline and toe inwards at 4 degrees as measured from their pivot points.

Each rudder has an elongated diamond shape with rounded leading (e.g., fore) and trailing (aft) edges. To illustrate, a width of each rudder increases from fore to midportion and then decreases from midportion to aft. In the example of FIG. 2, the midportion is the widest portion and also coincides with the pivot point. The interior and exterior sides of the rudders include flat, angled surfaces. These angled surfaces are angled with respect to a centerline of the hull and fore and aft direction of the hull and are also angled with respect to an angle of the rudder itself (a centerline of the rudder from tip to tip). The surfaces are flat with respect to a vertical axis (e.g., heave axis).

To illustrate the diamond shape, a fore interior surface of the first rudder (e.g., left rudder) angles inwards and a fore exterior surface of the first rudder angles outwards. An aft interior surface of the first rudder angles outwards and an aft exterior surface of the first rudder angles inwards. Similarly, a fore interior surface of the second rudder (e.g., right rudder) angles inwards and a fore exterior surface of the first rudder angles outwards. An aft interior surface of the second rudder angles outwards and an aft exterior surface of the second rudder angles inwards.

The angles of these angled surfaces may exacerbate the angle of the rudder itself or reduce the angle of the rudder itself depending on the surface and portion. In the example of FIG. 2, the fore interior surfaces of the rudders, along with the 4 degree toe in of the rudders generally, combine to form a total toe in angle of 11 degrees. That is, the water passing into and through the fore portion of the rudders experiences a larger angle and degree of toe in than the angle of the rudder itself. This causes drag and locally increases water pressure in the fore portion of the rudders. Conversely, the aft interior surfaces of the rudders, along with the 4 degree toe in of the rudders generally, combine to form a toe out angle of 3 degrees. Specifically, the outward angle of aft interior surfaces combined with the toe in of the rudders result in a net outwards or toe out angle. To illustrate, 7 degrees toe out for the aft surfaces (relative to the rudder centerline) plus 4 degrees toe in results in 3 degree toe out, and the water passing through the rudders from midportion to aft actually experiences toe out flow. This causes drag and locally decreases water pressure. This decrease in water pressure directly in front of the propeller reduces power and efficiency.

This decreased pressure can also be shown by a distance between the interior surfaces and a change in such distance from fore to aft. At an inlet formed by the rudders at the leading edge thereof, a distance between the rudders is 48 and ⅝ inches. This distance first decreases to 39 and ¼ inches at the midportion, which increases pressure. However, this distance then increases from 39 and ¼ inches to 41 and 15/16 inches at the trailing edge, which decreases pressure and propeller performance. The flow of water from the pivot point to the point of propulsion is disturbed by the relief or outward angle of the aft portion of the interior surface.

Figure 3:
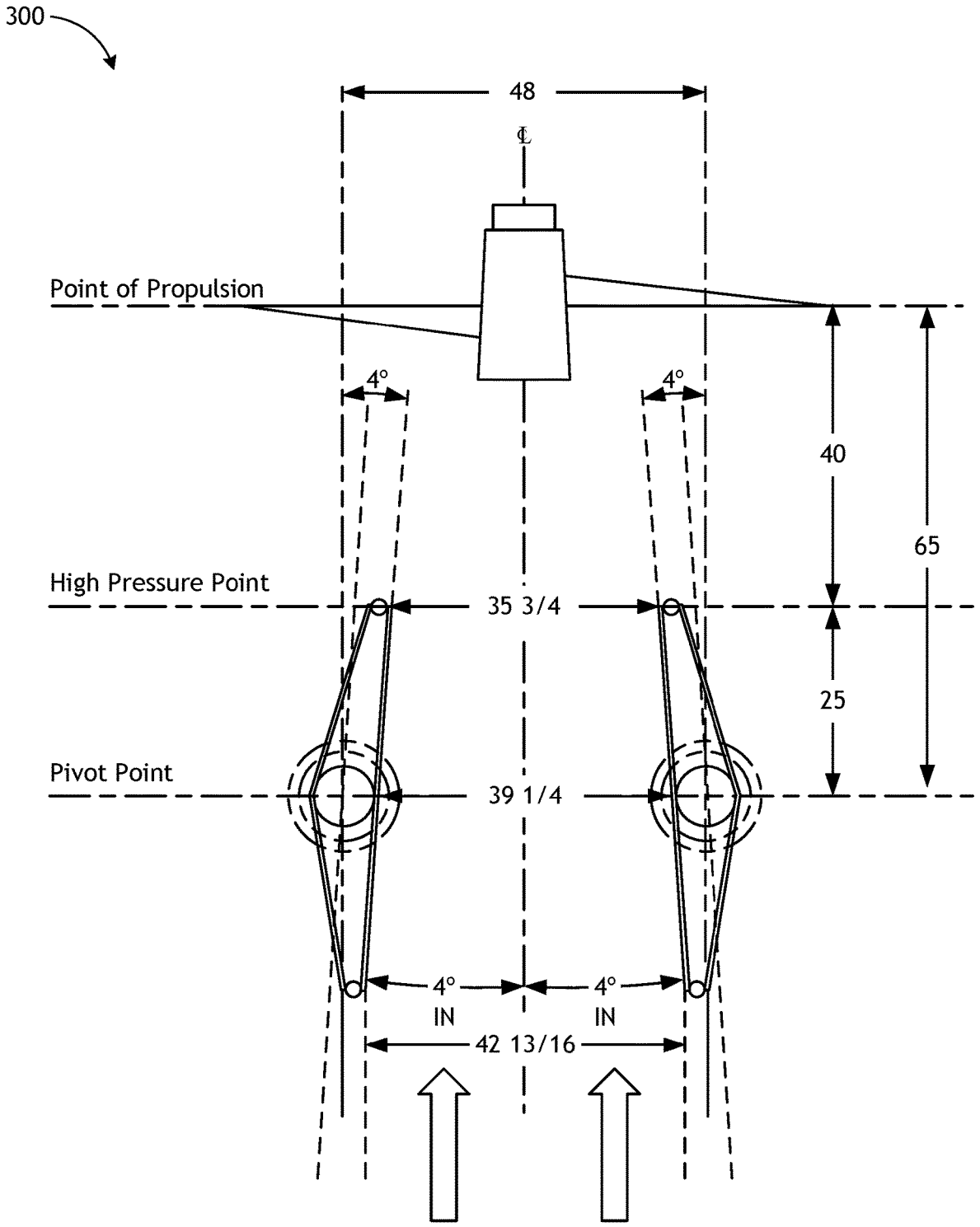
FIG. 3 is a transverse cross-section view of an example of asymmetric flanking rudders.

FIG. 3 illustrates a generic cross-section view 300 of a pair of asymmetrical rudders in relation to a propeller. That is each rudder of the pair has an asymmetrical shape. In the example of FIG. 3, each asymmetrical rudder has an asymmetrical shape with respect to a corresponding centerline of the respective rudder. To illustrate, a left side shape of the rudder may not match a right side shape of the rudder, and/or a fore portion of the rudder may not match an aft portion of the rudder. In the example of FIG. 3, the rudders have fore-aft symmetry but do not have left-right symmetry.

The rudders of the pair of asymmetrical rudders may be symmetrical with respect to one another. For example, in the example of FIG. 3, the rudders are symmetrical with respect to a centerline of the hull. To illustrate, each rudder is complementary or the mirror opposite the other. The rudders both are 24 inches from the centerline, toe inwards at 4 degrees as measured from their pivot points, and have the same shaped only flipped with respect to the centerline of the hull.

In the example of FIG. 3, each rudder has a flat, straight interior surface and an angled exterior surface with rounded fore and aft edges. To illustrate, a width of each rudder increases from fore to midportion and then decreases from midportion to aft due to the angled exterior surface. In the example of FIG. 3, the midportion also coincides with the pivot point. As the interior sides of the rudders include flat, straight surfaces, these straight surfaces are not angled with respect to an angle of the rudder itself (a centerline of the rudder from tip to tip). The exterior surfaces are angled and are comprised of two angled portions.

To illustrate the shape of the asymmetrical rudders of FIG. 3, the interior surface of the first rudder (e.g., left rudder) is straight and is angled inwards at substantially the same angle as the rudder itself. A fore exterior surface of the first rudder angles outwards, and an aft exterior surface of the first rudder angles inwards. Similarly, the interior surface of the second rudder (e.g., right rudder) is straight and is angled inwards at substantially the same angle as the rudder itself. Also, a fore exterior surface of the first rudder angles outwards, and an aft exterior surface of the second rudder angles inwards.

The angles of these straight surfaces may not exacerbate the angle of the rudder itself or reduce the angle of the rudder itself. In the example of FIG. 3, the interior surfaces of the rudders is the same 4 degree toe as that of the rudders generally. As compared to FIG. 2, the interior surfaces do not themselves have an angle which further compounds with the angle of rudder to increase the net amount of toe in. Thus, the water passing into and through the fore portion and aft portions of the rudders experience the same angle and degree of toe in. This causes relatively less drag and locally increases water pressure in both the fore and aft portions of the rudders. Thus, water pressure is increased throughout the rudders and in front of the propeller, and this increase in water pressure and location in front of the propeller increases power and efficiency.

This increased pressure can also be seen by the distance between the interior surfaces. At an inlet to the rudders and a leading edge thereof, a distance between the rudders is 42 and 13/16 inches. This distance first decreases to 39 and ¼ inches at the midportion, which increases pressure. Then, this distance then decreases again from 39 and ¼ inches to 35 and ¾ inches at the trailing edge, which further increases pressure and performance. The flow of water from the pivot point to the point of propulsion is not disturbed or disturbed to the same degree as the symmetric rudders in FIG. 2 because the aft portion of the interior surface has an inward angle and creates a high pressure point closer to the point of propulsion.

Figure 4:
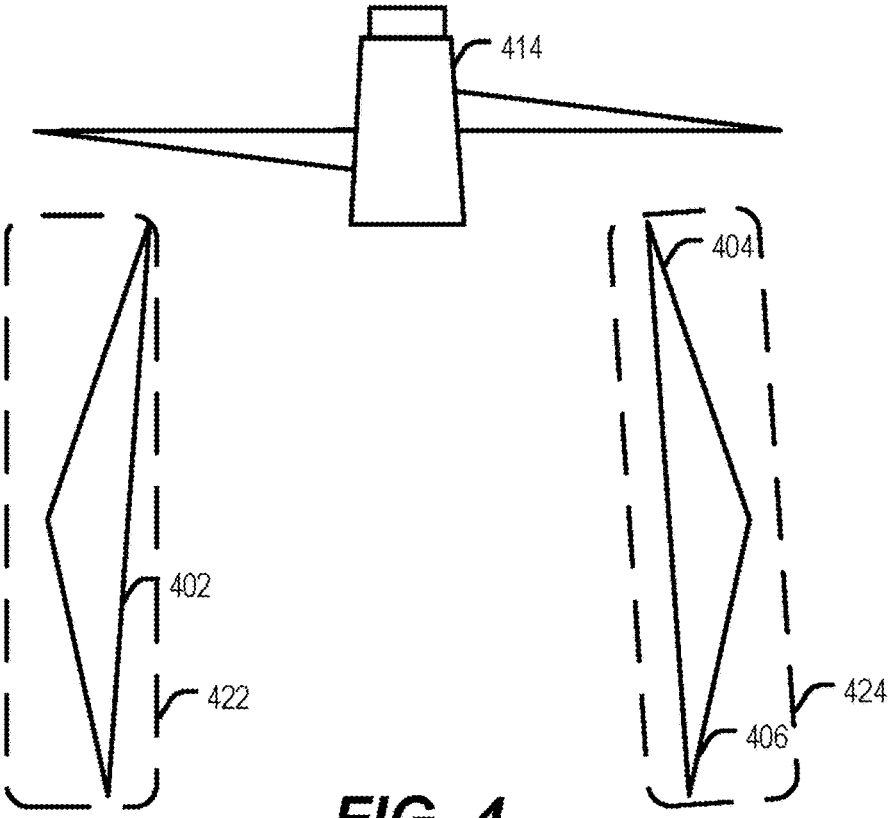
FIG. 4 is a transverse cross-section view of another example of asymmetric flanking rudders.
Figure 5:
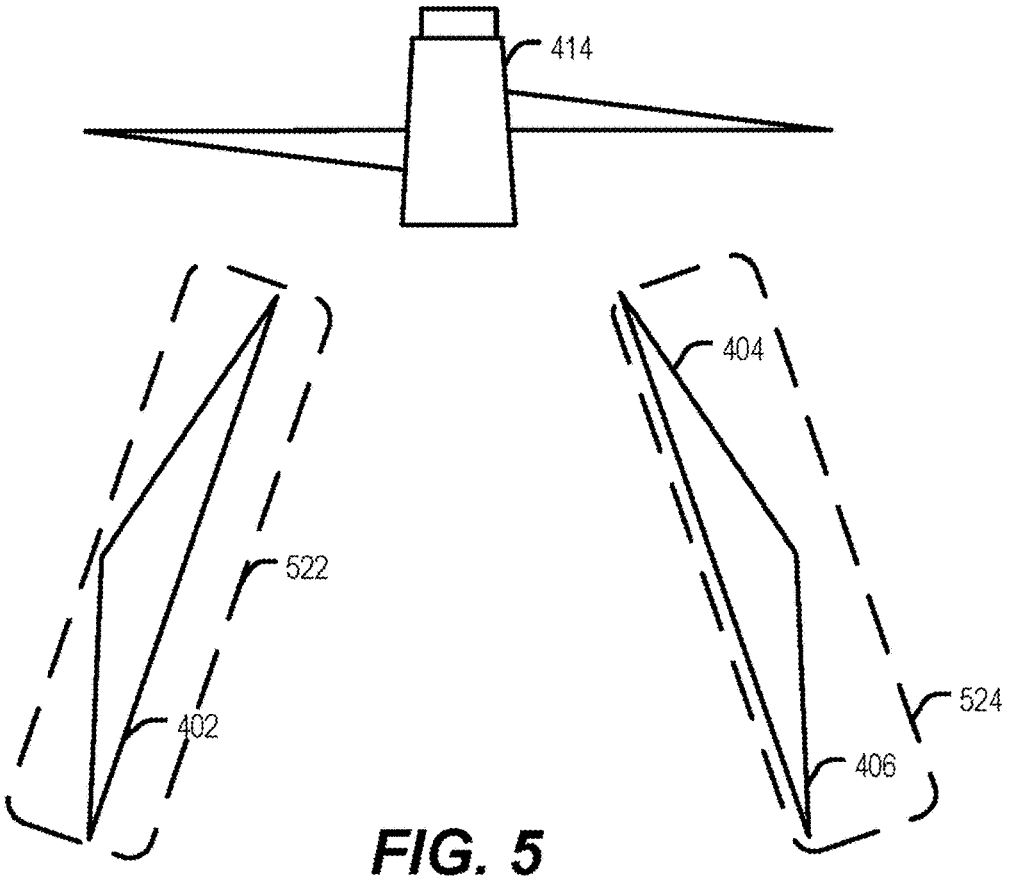
FIG. 5 is a transverse cross-section view of another example of asymmetric flanking rudders.
Figure 6:
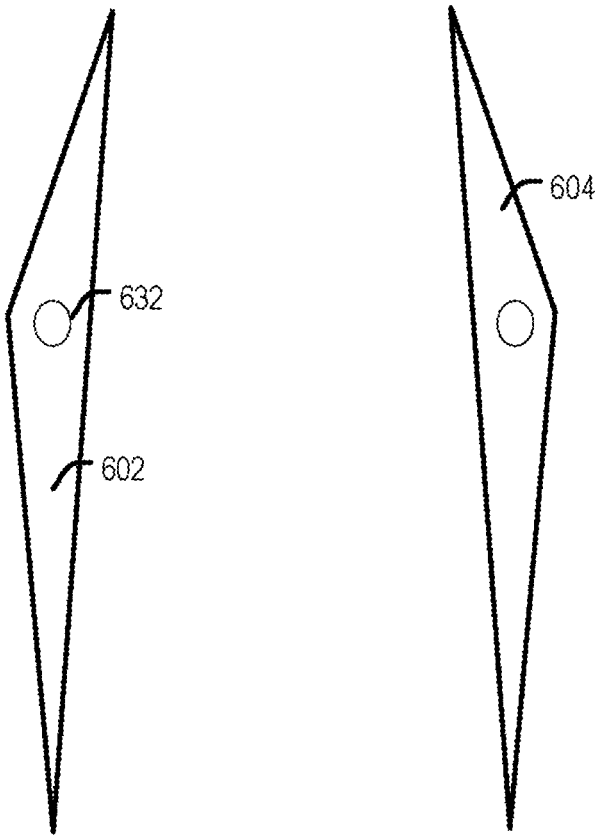
FIG. 6 is a transverse cross-section view of another example of asymmetric flanking rudders.
Figure 7:
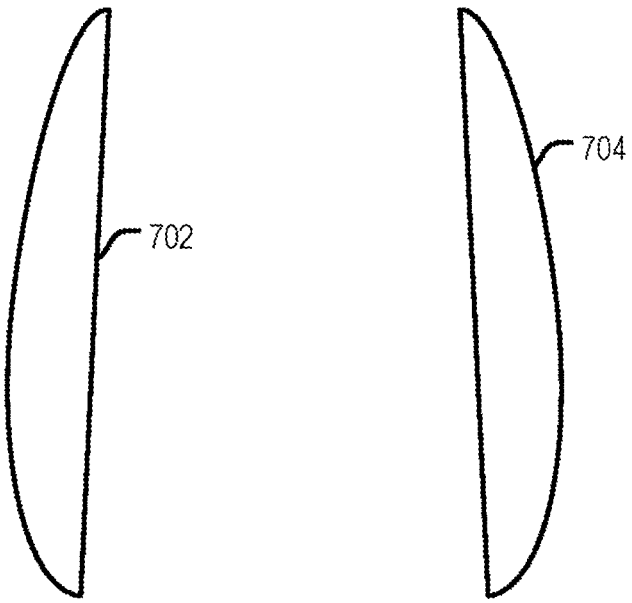
FIG. 7 is a transverse cross-section view of another example of asymmetric flanking rudders.
Figure 8:
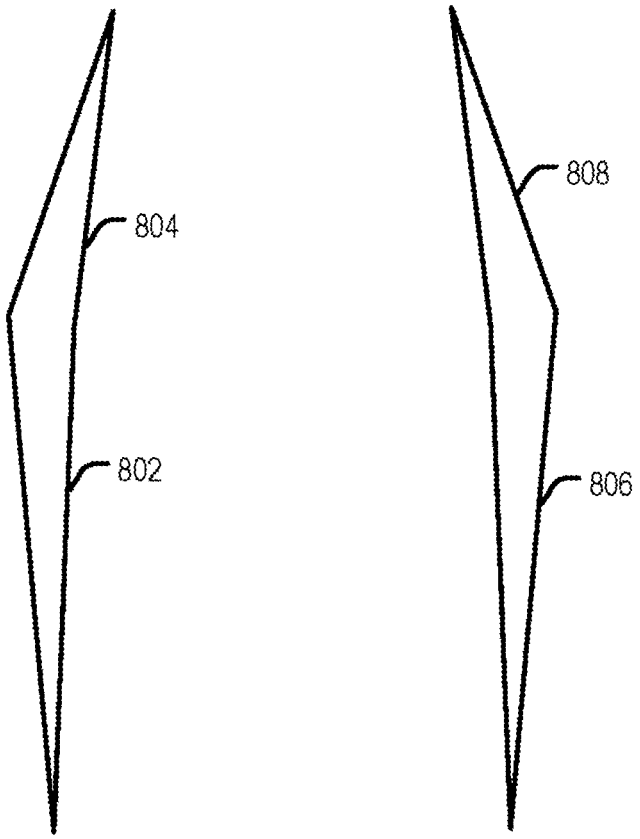
FIG. 8 is a transverse cross-section view of another example of asymmetric flanking rudders.
Figure 9:
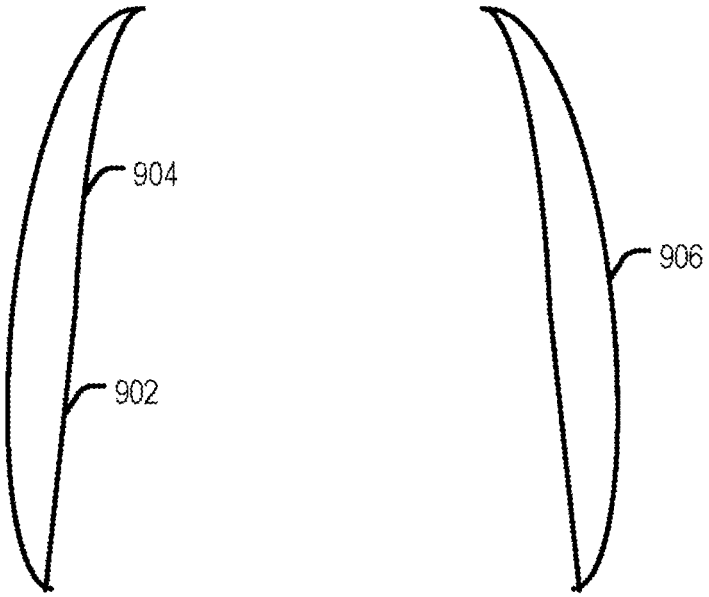
FIG. 9 is a transverse cross-section view of another example of asymmetric flanking rudders.
Figure 10:
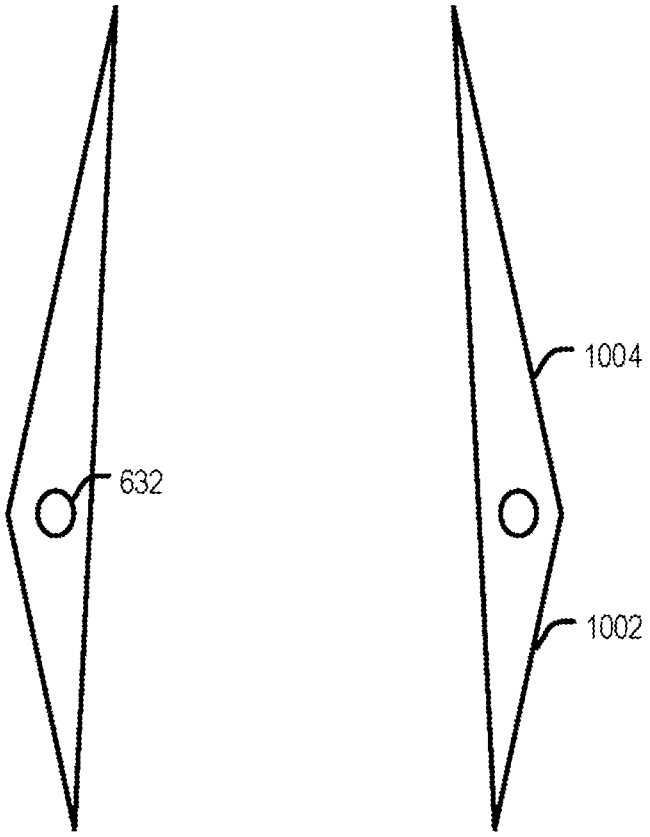
FIG. 10 is a transverse cross-section view of another example of asymmetric flanking rudders.

FIGS. 4-10 are each a cross-section diagram that illustrates an example of a pair of asymmetric flanking rudders, such as asymmetric flanking rudders 164 of FIG. 1, i.e., examples of asymmetric flanking rudder designs. FIG. 4 illustrates an example with a small toe in angle and sharp edges, FIG. 5 illustrates an example with a large toe in angle and sharp edges, FIG. 6 illustrates an example with a larger fore portion, FIG. 7 illustrates an example with rounded exterior surfaces, FIG. 8 illustrates an example with inward angled interior surfaces, FIG. 9 illustrates an example with curved (e.g., concave shaped) interior surfaces, and FIG. 10 illustrates an example with a larger aft portion.

Referring to FIGS. 4 and 5, cross section diagrams for a pair of asymmetric flanking rudders with sharp edges are illustrated upstream of a propulsion system 414. In FIG. 4, the asymmetric flanking rudders are arranged with a relatively smaller toe in angle as compared to FIG. 5.

Referring to FIG. 4, the asymmetric flanking rudders have a similar shape to the asymmetric flanking rudders of the example of FIG. 3. That is, the asymmetric flanking rudders have a straight, flat interior surface 402, and angled exterior surfaces 404 and 406. However, the asymmetric flanking rudders of FIG. 4 have sharper edges than the asymmetric flanking rudders of FIG. 3.

In FIG. 4, optional endplate configurations are also illustrated. In the example of FIG. 4, a left rudder has an endplate 422 with no toe angle and positioned such that the endplate extends further on the exterior side of the rudder. However, a right rudder has an endplate 424 with a matching toe angle (e.g. 4 degrees) and is positioned such that the endplate extends outwards from the rudder relatively the same amount on the interior and exterior sides.

Referring to FIG. 5, the asymmetric flanking rudders have a similar shape to the asymmetric flanking rudders of the examples of FIGS. 3 and 4. That is, the asymmetric flanking rudders have a straight, flat interior surface 402, and angled exterior surfaces 404 and 406. However, as compared to the asymmetric flanking rudders have a similar shape to the asymmetric flanking rudders of the example of FIG. 4, the asymmetric flanking rudders of FIG. 5 have a larger toe in angle.

In FIG. 5, additional optional endplate configurations are also illustrated. In the example of FIG. 5, a left rudder has an endplate 522 with a matching toe angle (e.g. 11 degrees) and is positioned such that the endplate extends further on the interior side of the rudder. However, a right rudder has an endplate 524 with a matching toe angle (e.g. 11 degrees) and is positioned such that the endplate extends further on the exterior side of the rudder.

Referring to FIG. 6, a cross section diagram for a pair of asymmetric flanking rudders with a larger fore portion is illustrated. In FIG. 6, the asymmetric flanking rudders are arranged such that a fore portion 602 (e.g., bottom portion as illustrated in FIG. 6) is longer and larger than an aft portion 604. To illustrate, a distance from a pivot point 632 to a leading edge of the fore portion 602 is larger than a distance from the pivot point 632 to a trailing edge of the aft portion 604. The pivot point may correspond to an attachment point for a rudder stock.

Referring to FIG. 7, a cross section diagram for a pair of asymmetric flanking rudders with rounded exterior surfaces is illustrated. In FIG. 7, the asymmetric flanking rudders are arranged such that exterior surfaces 704 are curved, i.e., concave shaped. Similar to the previous asymmetric flanking rudders, the interior surfaces 702 of the asymmetric flanking rudders are straight and arranged along the general rudder orientation. In the diagram of FIG. 7, a leading edge of the asymmetric flanking rudders is thicker than a trailing edge, and the exterior surfaces curves such that the asymmetric flanking rudders taper from thicker to thinner. Such a design may increase a pressure of the water between the asymmetric flanking rudders similar to an wing or airfoil of an aircraft. Alternatively, in other implementations, the asymmetric flanking rudders may have a constant thickness or an increasing thickness.

Referring to FIG. 8, a cross section diagram for a pair of asymmetric flanking rudders with angled interior surfaces 802 and 804 is illustrated. In FIG. 8, the asymmetric flanking rudders are arranged such that exterior surfaces 806 and 808 are angled. Similar to the previous asymmetric flanking rudders, the angled interior surfaces 802 and 804 of the asymmetric flanking rudders are arranged along the general rudder orientation. In other implementations, the exterior surfaces 806 and 808 may be curved, such as described with reference to FIGS. 7 and 9.

Referring to FIG. 9, a cross section diagram is illustrated for a pair of asymmetric flanking rudders where at least a portion of the interior surfaces are rounded. In FIG. 9, the asymmetric flanking rudders are arranged such that an aft portion 904 of interior surfaces are curved, i.e., concave shaped. A fore portion 902 of the interior surfaces may be straight and flat, similar to interior surface of FIG. 8. In other implementations, the asymmetric flanking rudders may be arranged such that an entirety of the interior surfaces are curved, i.e., concave shaped.

Additionally, similar to the asymmetric flanking rudder of FIG. 7, the exterior surfaces 906 of the asymmetric flanking rudders are curved as well in the example of FIG. 9. Alternatively, the exterior surfaces of the asymmetric flanking rudders may be angled in other implementations, similar to many of the previous asymmetric flanking rudders.

Referring to FIG. 10, a cross section diagram a pair of asymmetric flanking rudders with a larger aft portion is illustrated. In FIG. 10, the asymmetric flanking rudders are arranged such that an aft portion 1004 (e.g., top portion as illustrated in FIG. 10) is longer and larger than a fore portion 1002. To illustrate, a distance from a pivot point 632 to a leading edge (e.g., bottom edge as illustrated in FIG. 10) of the fore portion 1002 is smaller than a distance from the pivot point 632 to a trailing edge (e.g., top edge as illustrated in FIG. 10) of the aft portion 1004.

The asymmetric flanking rudders illustrated in FIGS. 4-10 are some examples of the asymmetric flanking rudders described herein. Other asymmetric flanking rudders may include one or more features of the example asymmetric flanking rudders of FIGS. 4-10. For example, the curved exterior of FIG. 7 may be combined with any of the endplates of FIG. 4 or 5. As another example, the angled interior of FIG. 8 may be combined with any feature of FIG. 4-7, 9, or 10.

Figure 11:
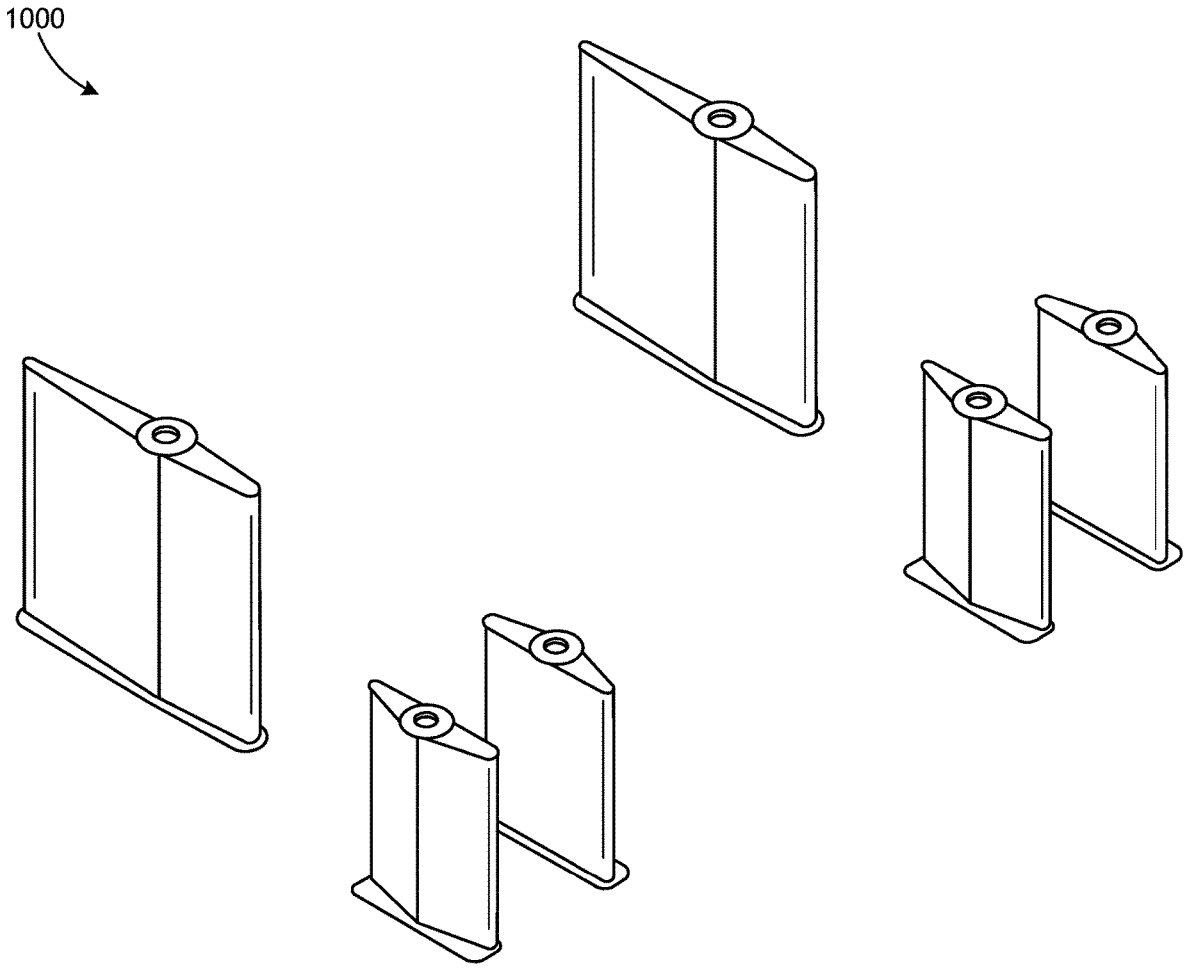
FIG. 11 is a perspective view of an example of rudder configuration with asymmetric flanking rudders.

FIG. 11 is an isometric view of a rudder system 1100 for a dual propulsion marine vessel. The rudder system of FIG. 11 includes two pairs of asymmetric flanking rudders and two propulsion rudders. Each pair of asymmetric flanking rudders and propulsion rudder is associated with a propulsion device, not shown. The propulsion device may include a propeller which is positioned between the asymmetric flanking rudders and the propulsion rudder.

As illustrated in FIG. 11, the asymmetric flanking rudders may be positioned on the sides of their corresponding propulsion rudder and upstream or fore of the propulsion rudder. FIG. 11, further illustrates that the propulsion rudders themselves may be asymmetrical from fore to aft and include a pivot point that is located fore of the midportion. In other implementations, the propulsion rudders may be symmetrical in one or more dimensions.

In some implementations, one or more of the rudders may include endplates. An endplate may include or correspond to a material which extends from or is coupled to a bottom edge or surface of the rudder. The end plate may include a flat and relatively thin piece of material which protrudes from the interior and/or exterior surfaces of the rudder. As illustrated in the example of FIG. 11, the endplates are rectangular in shape and have chamfered edges, the endplates extend from the interior and exterior surfaces of the rudders. The endplates also do not extend uniformly from the interior and exterior surfaces in the example of FIG. 11. As the asymmetric flanking rudders have a flat, straight interior side, the endplate protrudes from the exterior sides to a greater extent than the interior sides in FIG. 11. Additionally, with respect to the exterior sides, the endplate extends from the fore and aft of the asymmetric flanking rudders to a great extent than the midportion of the asymmetric flanking rudders.

Figure 12:
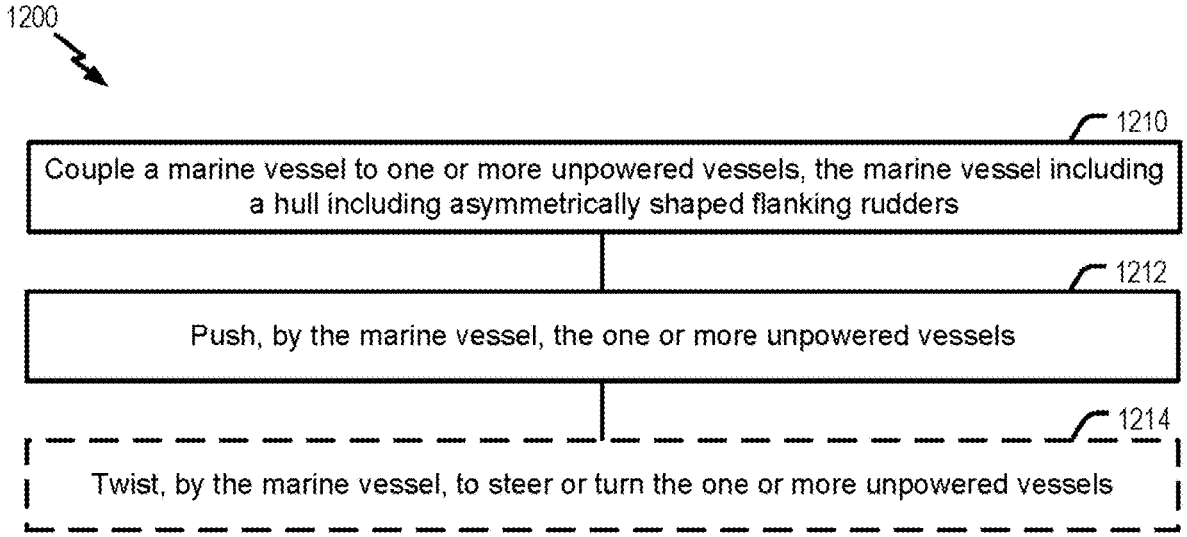
FIG. 12 is a flowchart illustrating an example of a method of operating a marine vessel including asymmetric flanking rudders.

FIG. 12 illustrates a method 1200 of operating a hybrid chine hull vessel. The method 1300 may be performed at or by marine vessel 102 or another vessel including a hybrid chine hull described herein.

Method 1200 includes coupling a marine vessel to one or more unpowered vessels, the marine vessel including a hull including asymmetrical flanking rudders, at 1210. For example, the asymmetrical flanking rudders may include or correspond to asymmetrical flanking rudders 164. The one or more unpowered vessels may include or correspond to one or more barges. In some implementations, the one or more barges are aligned lengthwise. Additionally, or alternatively, a particular barge of the one or more barges has an under keel clearance of 1-10 feet.

Method 1200 further includes pushing, by the marine vessel, the one or more unpowered vessels, at 1212. For example, the marine vessel is positioned behind the barges and operates the propulsion system 114 in a forward direction to push the barges. The marine vessel may push the one or more barges at different speeds, such as speeds of 3 knots to 15 knots.

Method 1200 optionally includes twisting, by the marine vessel, to steer or turn the one or more unpowered vessels, at 1214. For example, the control system 116 may send control signals to propulsion rudders 162 and asymmetric flanking rudders 164 to orient the rudders 162, 164 such that torque is applied to marine vessel 102. To illustrate, rudder stocks of the rudders 162, 164 are rotated to rotate the rudders 162, 164 about their respective pivot points to divert water and induce torque. The torque causes marine vessel 102 and the one or more barges will to twist, thus enabling marine vessel 102 to steer and turn the one or more barges. Thus, method 1200 describes operation of a vessel including asymmetric flanking rudders, and the asymmetric flanking rudders may enable increased performance, increased efficiency, and improved safety.

In some implementations, a boat hull includes: a keel; and asymmetrically shaped flanking rudders coupled to the keel, wherein a first flanking rudder of the asymmetrically shaped flanking rudder includes an interior surface having a first shape and an exterior surface having a second shape different from the first shape.

In a first aspect, a second flanking rudder of the asymmetrically shaped flanking rudder includes an exterior surface having the first shape and an exterior surface having the second shape.

In a second aspect, alone or in combination with the first aspect, the interior surfaces of the first and second flanking rudders are straight.

In a third aspect, alone or in combination with one or more of the above aspects, the exterior surfaces of the first and second flanking rudders are rounded.

In a fourth aspect, alone or in combination with one or more of the above aspects, the exterior surfaces of the first and second flanking rudders are angled relative to a centerline of the boat hull.

In a fifth aspect, alone or in combination with one or more of the above aspects, the asymmetrically shaped flanking rudders are orientated toe in with an offset angle between 2 and 6 degrees relative to a centerline of the boat hull.

In a sixth aspect, alone or in combination with one or more of the above aspects, interior surfaces of the asymmetrically shaped flanking rudders are orientated toe in with an offset angle between 2 and 6 degrees relative to a centerline of the boat hull.

In a seventh aspect, alone or in combination with one or more of the above aspects, the exterior surface of the first flanking rudder comprises two exterior surface portions, and wherein the two exterior surface portions are offset at an angle from one another.

In an eighth aspect, alone or in combination with one or more of the above aspects, the exterior surfaces have different angles fore and aft.

In a ninth aspect, alone or in combination with one or more of the above aspects, of the first and second flanking rudders are angled relative to a centerline of the boat hull.

In a tenth aspect, alone or in combination with one or more of the above aspects, the interior surfaces are rounded.

In an eleventh aspect, alone or in combination with one or more of the above aspects, the first flanking rudder has a shape that mirrors the shape of the second flanking rudder.

In a twelfth aspect, alone or in combination with one or more of the above aspects, the asymmetrically shaped flanking rudders are complimentary rudders.

In a thirteenth aspect, alone or in combination with one or more of the above aspects, the first flanking rudder comprises a flat plate positioned at a bottom surface of the first flanking rudder.

In a fourteenth aspect, alone or in combination with one or more of the above aspects, an exterior edge of the flat plate protrudes from the exterior surface of the first flanking rudder.

In a fifteenth aspect, alone or in combination with one or more of the above aspects, the first flanking rudder has an symmetrical shape with respect to a vertical axis.

In a sixteenth aspect, alone or in combination with one or more of the above aspects, the first flanking rudder has an asymmetrical shape with respect to the z axis.

In a seventeenth aspect, alone or in combination with one or more of the above aspects, the boat hull further includes propulsion rudders coupled to the keel aft of the asymmetrically shaped flanking rudders.

In an eighteenth aspect, alone or in combination with one or more of the above aspects, the keel comprises a flat plate keel.

In a nineteenth aspect, alone or in combination with one or more of the above aspects, the hull comprises a hybrid chine boat hull.

In a twentieth aspect, alone or in combination with one or more of the above aspects, the hybrid chine boat hull comprises a single chine section and a double chine section.

In a twenty-first aspect, alone or in combination with one or more of the above aspects, the single chine section includes a single chine on each side of the keel, and wherein the double chine section includes an upper chine and a lower chine on each side of the keel.

In a twenty-second aspect, alone or in combination with one or more of the above aspects, the hybrid chine hull includes a transition between the single chine section and the double chine section, the transition positioned in an aft portion of the hull.

In a twenty-third aspect, alone or in combination with one or more of the above aspects, the keel further defines a tunnel cavity.

In a twenty-fourth aspect, alone or in combination with one or more of the above aspects, the boat hull further includes one or more storage compartments defined by the hull.

In a twenty-fifth aspect, alone or in combination with one or more of the above aspects, the boat hull includes a generally rectangular-shaped upper hull portion.

In a twenty-sixth aspect, alone or in combination with one or more of the above aspects, the boat hull includes a frame, the frame including a plurality of frame members coupled to the keel.

In a twenty-seventh aspect, alone or in combination with one or more of the above aspects, the booth hull includes a bow and a stern.

In some implementations, a marine vessel includes: a hull, including a keel and asymmetrically shaped flanking rudders; a propulsion system; and a control system.

In a first aspect, the propulsion system comprising an engine and a propeller.

In a second aspect, alone or in combination with the first aspect, the control system includes a controller.

In a third aspect, alone or in combination with one or more of the above aspects, the control system comprising one or more propulsion rudders, the propulsion rudders positioned aft of the propeller and the asymmetrically shaped flanking rudders.

In a fourth aspect, alone or in combination with one or more of the above aspects, the control system configured to rotate the asymmetrically shaped flanking rudders.

In a fifth aspect, alone or in combination with one or more of the above aspects, the control system configured to adjust an offset angle of one or more flanking rudders of the asymmetrically shaped flanking rudders.

In a sixth aspect, alone or in combination with one or more of the above aspects, a bow of the marine vessel is flat and configured to push one or more barges.

In a seventh aspect, alone or in combination with one or more of the above aspects, the marine vessel comprises an inland push boat.

In an eighth aspect, alone or in combination with one or more of the above aspects, the marine vessel comprises an offshore supply boat.

In some implementations, a method of using asymmetrical flanking rudders includes: coupling a marine vessel to one or more unpowered vessels, the marine vessel comprising a hull including asymmetrically shaped flanking rudders; and pushing, by the marine vessel, the one or more unpowered vessels.

In a first aspect the method further includes twisting, by the marine vessel, to steer or turn the one or more unpowered vessels.

In a second aspect, alone or in combination with one or more of the above aspects, twisting by the marine vessel includes adjusting a position of the asymmetrically shaped flanking rudders.

In a third aspect, alone or in combination with one or more of the above aspects, the method further includes ceasing pushing, by the marine vessel, the one or more unpowered vessels.

In a fourth aspect, alone or in combination with one or more of the above aspects, the method further includes decoupling the marine vessel from the one or more unpowered vessels.

In a fifth aspect, alone or in combination with one or more of the above aspects, the one or more unpowered vessels comprises barges.

In a sixth aspect, alone or in combination with one or more of the above aspects, at least one barge of the one or more barges is longer than 250 feet, the at least one barge of the one or more barges has an under keel clearance of 1 foot to 10 feet, or a combination thereof.

In a seventh aspect, alone or in combination with one or more of the above aspects, the marine vessel is operated at a speed of between 3 knots and 15 knots while pushing the one or more unpowered vessels.

The above specification and examples provide a complete description of the structure and use of illustrative examples. Although certain aspects have been described above with a certain degree of particularity, or with reference to one or more individual examples, those skilled in the art could make numerous alterations to aspects of the present disclosure without departing from the scope of the present disclosure. As such, the various illustrative examples of the methods and systems are not intended to be limited to the particular forms disclosed. Rather, they include all modifications and alternatives falling within the scope of the claims, and implementations other than the ones shown may include some or all of the features of the depicted examples.

For example, elements may be omitted or combined as a unitary structure, connections may be substituted, or both. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one example or may relate to several examples. Accordingly, no single implementation described herein should be construed as limiting and implementations of the disclosure may be suitably combined without departing from the teachings of the disclosure.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims. The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A boat hull comprising:

a keel;

asymmetrically shaped flanking rudders coupled to the keel, wherein a first flanking rudder of the asymmetrically shaped flanking rudder includes an interior surface having a first shape and an exterior surface having a second shape different from the first shape, and wherein the asymmetrically shaped flanking rudders are positioned fore of a propulsion device; and one or more propulsion rudders coupled to the keel aft of the asymmetrically shaped flanking rudders and the propulsion device.

2. The boat hull of claim 1, wherein a second flanking rudder of the asymmetrically shaped flanking rudders includes an interior surface having the first shape and an exterior surface having the second shape.

3. The boat hull of claim 2, wherein the interior surfaces of the first and second flanking rudders are straight.

4. The boat hull of claim 2, wherein the interior surfaces of the first and second flanking rudders are rounded.

5. The boat hull of claim 1, wherein the asymmetrically shaped flanking rudders are orientated toe in with an offset angle between 2 and 6 degrees relative to a centerline of the boat hull.

6. The boat hull of claim 1, wherein interior surfaces of the asymmetrically shaped flanking rudders are orientated toe in with an offset angle between 2 and 6 degrees relative to a centerline of the boat hull.

7. The boat hull of claim 1, wherein the exterior surfaces of the asymmetrically shaped flanking rudders are rounded.

8. The boat hull of claim 1, wherein the exterior surface of the first flanking rudder comprises two exterior surface portions, and wherein the two exterior surface portions are offset at an angle from one another, wherein the two exterior surfaces portions have different angles from one another.

9. The boat hull of claim 1, wherein the first flanking rudder has a shape that mirrors the shape of a second flanking rudder of the first and second flanking rudders are, and wherein the first flanking rudder has an symmetrical shape with respect to a vertical axis.

10. The boat hull of claim 1, wherein the first flanking rudder comprises a flat plate positioned at a bottom surface of the first flanking rudder.

11. The boat hull of claim 10, wherein an exterior edge of the flat plate protrudes from the exterior surface of the first flanking rudder.

12. The boat hull of claim 1, further comprising a plurality of propulsion devices including the propulsion device, wherein the one or more propulsion rudders include multiple propulsion rudders, each propulsion rudder associated with a propulsion device of the plurality of propulsion devices.

13. The boat hull of claim 1, wherein the boat hull comprises a hybrid chine boat hull.

14. The boat hull of claim 13, wherein the hybrid chine boat hull comprises a single chine section and a double chine section, wherein the propulsion device comprises a propeller, and wherein the keel comprises a flat plate keel.

15. The boat hull of claim 1, further comprising a bow and a stern, wherein the keel further defines a tunnel cavity.

16. A marine vessel comprising:

a hull, the hull comprising:

a keel; and asymmetrically shaped flanking rudders, wherein a first flanking rudder of the asymmetrically shaped flanking rudder includes an interior surface having a first shape and an exterior surface having a second shape different from the first shape;

a propulsion system, wherein the asymmetrically shaped flanking rudders are positioned fore of a propulsion device of the propulsion system; and a control system, the control system comprising one or more propulsion rudders, wherein the propulsion rudders are positioned aft of the asymmetrically shaped flanking rudders.

17. The marine vessel of claim 16, the propulsion system comprising an engine and a propeller, and the control system further comprising a controller, wherein the one or more propulsion rudders are positioned aft of the propeller.

18. The marine vessel of claim 16, the control system configured to rotate the asymmetrically shaped flanking rudders.

19. The marine vessel of claim 16, the control system configured to adjust an offset angle of one or more flanking rudders of the asymmetrically shaped flanking rudders.

20. The marine vessel of claim 16, wherein the marine vessel comprises an inland push boat, and wherein a bow of the marine vessel is flat and configured to push one or more barges.

* * * * *